US006125023A

United States Patent [19]

Bezek, Sr.

[11] Patent Number: 6,125,023

[45] Date of Patent: Sep. 26, 2000

[54] CIRCUIT BREAKER RECEPTACLE

[76] Inventor: Donald J. Bezek, Sr., 806 Brighton La., LaGrange, Ill. 60525

[21] Appl. No.: 09/252,084

[22] Filed: Feb. 10, 1999

[51] Int. Cl.[7] ..... H02H 3/00

[52] U.S. Cl. ..... 361/93.3; 361/93.6; 361/102; 361/115

[58] Field of Search ..... 361/93.1, 93.3, 361/93.6, 102, 115; 439/490, 107

[56] References Cited

U.S. PATENT DOCUMENTS 4,077,055 2/1978 Wilson et al. ..... 361/46
4,649,455 3/1987 Scott ..... 361/93.3
4,958,252 9/1990 Murphy ..... 361/93.3
5,428,495 6/1995 Murphy et al. ..... 361/85
5,844,765 12/1998 Kato et al. ..... 361/115

*Primary Examiner*—Michael J. Sherry
*Attorney, Agent, or Firm*—Hill & Simpson

[57] ABSTRACT

A circuit breaker receptacle is provided in which there is a circuit breaker to be used to protect a sub-circuit in an alternating current electrical circuit. A range plug is connected to the circuit breaker range processor to set an ampere value to be detected and interrupted by the circuit breaker. A variety of differently valued range plugs can be available so that the sub-circuit can be protected at various amperage values, thus permitting a plurality of individually protected sub-circuits to extend from a single main circuit. The sub-circuits will each be protected at a lower amperage value than the main circuit.

20 Claims, 2 Drawing Sheets

FIG. 1
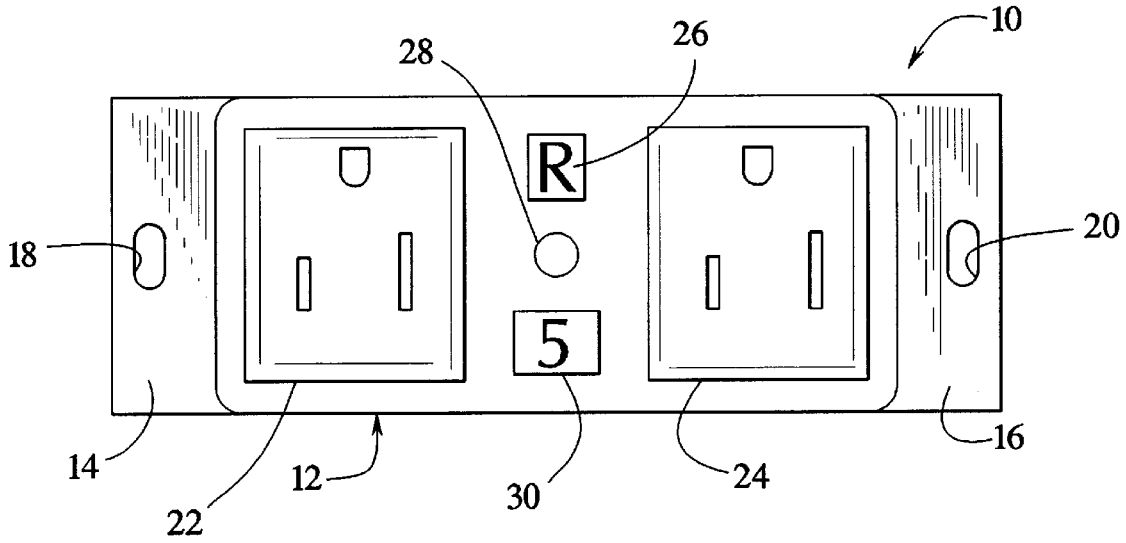
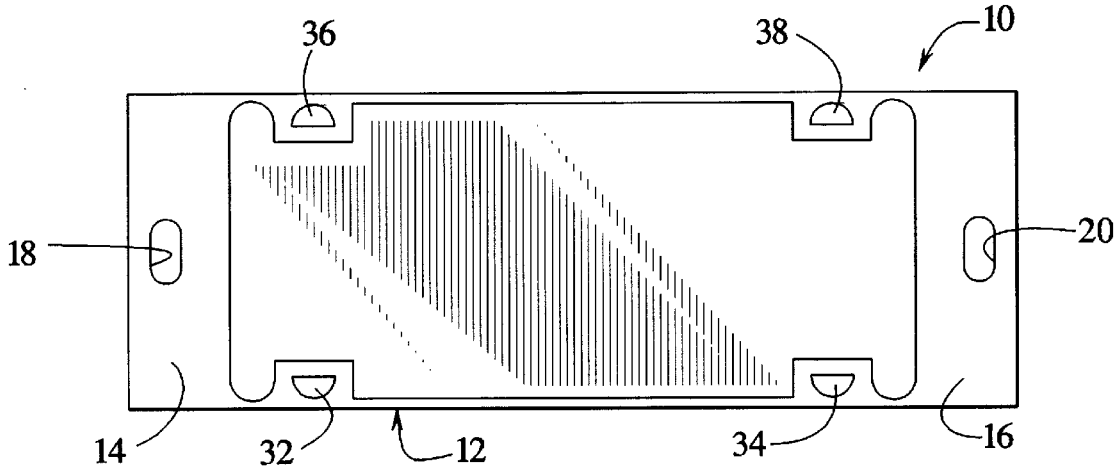
FIG. 2

CIRCUIT BREAKER RECEPTACLE

BACKGROUND OF THE INVENTION

The present invention relates to a circuit breaker receptacle, and more particularly, to a circuit breaker (over current protector) for a branch circuit in an alternating current circuit.

Circuit breaker devices are well known for use in alternating current lines, such as those found in homes, offices, factories, apartments and similar structures. Typically a circuit breaker panel will be located in a utility area at a point where the circuits originate. Alternatively, in certain types of construction, such as apartment buildings, circuit breakers may be provided within each living unit, with a separate breaker provided for each circuit.

Typically circuits are provided with a 15 or 20 amp circuit breaker with a number of different outlets provided on each circuit. With a 20 amp circuit, 12 gauge wire can be used.

In some instances, where a particularly large load, such as an air conditioning unit, is to be used, a 30 amp circuit may be provided, but then a heavier, 10 gauge wire is required and special receptacles capable of handling 30 amps need to be used as well.

Oftentimes an individual circuit, particularly in an office or laboratory environment, may include outlets in more than one work area, so that if a circuit breaker is tripped, there will be power interruption to all of the outlets on that circuit which may include more than one work area.

It would be an improvement in the art if there were provided a mechanism for splitting circuits into individually protected branch or sub-circuits so that power interruption in one group of outlets would not result in a power interruption in another outlets which typically would be on the same originating circuit. Further, it would be an advantage if there were provided a local reset for individual sub-circuits so that a user could reset the circuit breaker locally rather than relying on maintenance personnel in an office or commercial environment.

SUMMARY OF THE INVENTION

The present invention provides a circuit breaker receptacle which provides for a branch circuit, with circuit breaker protection and local reset ability. A circuit breaker receptacle is provided which connects to a circuit, such as a 30 amp or higher circuit coming from a source of alternating current. The circuit breaker receptacle would be a first device in a string or sub-circuit and other devices downstream of the circuit breaker receptacle in that sub-circuit would have local protection by the circuit breaker receptacle. The circuit breaker receptacle could be provided with a range plug as an interchangeable field plug-in device or could be provided with a range plug that is not interchangeable. The range plug would determine the maximum current limit in amperes that the circuit breaker device would allow before tripping. For example, a range plug of 5 amps could be provided to provide a 5 ampere sub-circuit. This range plug could be removed and replaced with a higher rated range plug, for example, 15 amps or 20 amps so that the maximum current allowed on the sub-circuit would be that of the range plug. The circuit breaker receptacle would also have a reset button that would extend or protrude when current in excess of the rating of the range plug is exceeded. To reset the circuit breaker receptacle, the reset button would need to be pressed back into the receptacle.

Also, a visual indicator such as a light emitting diode (LED) could be provided on the circuit breaker receptacle to indicate that the breaker is reset and power is available at the circuit breaker receptacle.

As mentioned, the circuit breaker receptacle could be tapped onto a 30 amp or higher circuit to provide a sub-circuit with a lower amperage maximum limit or over current protection. This would allow for a lower number of total circuits to be provided than if all circuits were provided at a 20 amp rating.

By providing a local reset, a trip of the circuit breaker would allow the local user to reset the circuit rather than going off to find the circuit breaker panel at some other location or calling maintenance personnel to reset the circuit. For example, if such an arrangement were used in a hotel or motel room, the guest could be instructed how to reset the circuit rather than requiring maintenance personnel to undertake this activity.

The circuit breaker receptacle can be used in prefabricated office partitions, service work benches, and multiple outlet installations resulting in fewer main circuits being required and also resulting in the advantage that a local short circuit or overload would not shut down other nearby outlets which are on other local sub-circuits. For example, with a 30 amp main circuit, at least six 5 amp sub-circuits could be utilized thus providing six localized circuits which would not interfere with one another and resulting in only a single 30 amp circuit from the main power supply, rather than six separate 15 or 20 amp circuits to achieve separate circuits that are not impacted by failure in adjacent areas, or two separate 15 amp circuits to provide the same load capability, yet which will not provide individualized areas of protection.

Thus, the present invention will allow for a fewer number of main circuits coming from the power supply and will also provide individualized areas of protection which can be reset locally.

BRIEF DESCRIPTION OF THE DRAWINGS

FIG. 1 is a front elevational view of a circuit breaker receptacle embodying the principles of the present invention.

FIG. 2 is a rear elevational view of the circuit breaker receptacle of FIG. 1.

DETAILED DESCRIPTION OF THE PREFERRED EMBODIMENTS

Figure 3:
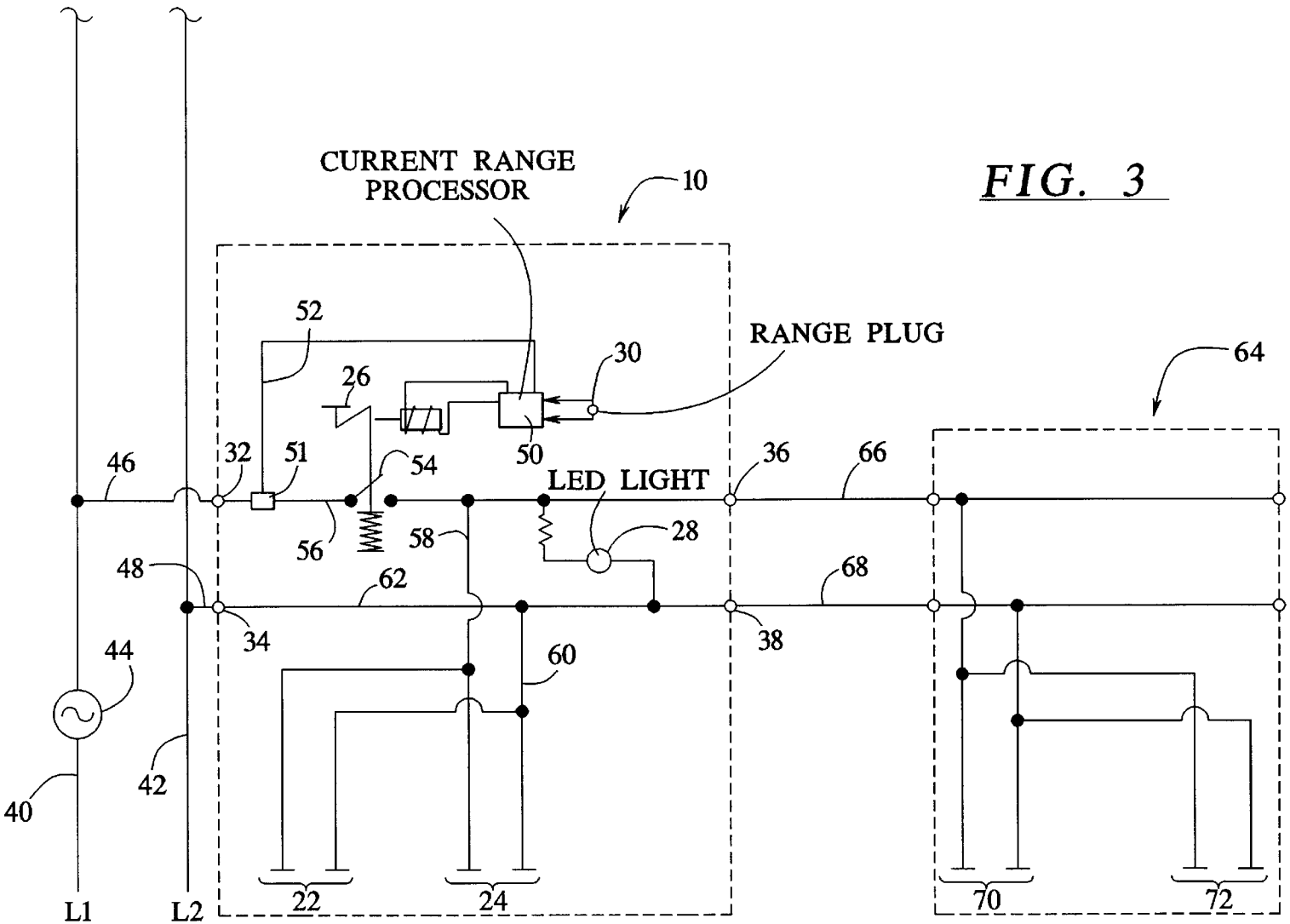
FIG. 3 is an electrical schematic diagram of the circuit breaker receptacle positioned in an electrical circuit.

In FIG. 1 there is illustrated a circuit breaker receptacle generally at 10 which embodies the principles of the present invention. This receptacle includes a housing 12 for receiving the various components of the receptacle. The housing has a pair of flanges 14, 16 located at each end and each flange has an oval slot or opening 18, 20 through which a mounting screw can be inserted to securely hold the receptacle 10 in an electrical box as is well known for electrical outlets, switches, etc. The receptacle includes two electrical outlets 22, 24 and, on the front face, there is a reset trip free button 26, there may be an illuminated indicator 28 such as an LED light 28 and there could be a removable and replaceable range plug 30.

Alternatively, the range plug 30 could be located on the back of the receptacle or interior of the receptacle. When the range plug 30 is located on the front face, it could be field interchangeable, so that differing amperage limits could be selected for the sub-circuit it is connected to. If located on the rear or interior, the range plug would not be so interchangeable, or may, in fact be permanently installed.

On a back side of the receptacle, as shown in FIG. 2, there are two openings 32, 34 leading to terminals for receiving electrical wires connected to a source of alternating current. Although the present invention is useful in standard household wiring in the United States which has a voltage potential of 110–120 volts, the invention is also useful in lower voltage systems, as well as higher voltage systems including 220–240 volt systems and higher. There are two additional openings 36, 38 into which other electrical wires can be inserted to engage a second pair of terminals to provide a circuit breaker protection to sub-circuit(s).

FIG. 3 illustrates part of an electrical circuit in which the receptacle 10 can be utilized. As shown in this figure, 120 volt alternating current is supplied by electrical lines 40, 42. Line 40 is commonly referred to as the hot line or hot lead and line 42 is commonly referred to as the neutral line or neutral lead. A circuit protection device 44 is provided in line 40 and can, for example, comprise a 30 amp protection device such as a fuse or circuit breaker at the point of circuit origin. Thus, lines 40 and 42 comprise a 30 amp circuit, of course, a higher rated protection device 44 could be provided to result in a circuit with a higher amperage rating.

A sub-circuit is provided with electrical lines 46, 48 which are connected to lines 40 and 42 respectively. The electrical lines 46, 48 are received in openings 32, 34 of the receptacle 10 to connect to the first pair of terminals therein and provide 120 volt electrical power to the receptacle 10.

Within the receptacle 10 is a circuit breaker device, which in most respects, can be similar to currently available circuit breakers. Thus, there typically is a current detector 51 which provides a current signal through electrical line 52 and which measures current flowing in through line 46 as it enters the receptacle 10. The range plug 30 is a novel feature of this receptacle and may be removably connectable to a typical current range processor 50 and is used to set the maximum current level for detection by the current range processor 50. For example, a range plug 30 having a value of 5 amps can be used and plugged into the current range processor 50. If a current signal from line 52 is provided to the current range processor 50 equal to or in excess of 5 amps, the current range processor 50, generally through a trip solenoid, will cause a load break switch 54 to open (usually by spring action) and will cause the reset button 26 to move outwardly and protrude from the face of the receptacle 10. When this occurs, a break in the internal electrical line 56 leading from line 46 will occur, thereby preventing current flow beyond the switch 54. When the reset button 26 is pressed back into the face of the receptacle 10, the switch 54 will be mechanically closed, allowing current to flow along line 56 unless the current flow is still in excess of the range plug. If the current flow is still in excess of the value set by the range plug, the reset button 26 will again extend and the switch 54 will immediately open.

The range plug is selected as an electrical component as required by the circuitry to establish the current trip point for the circuit breaker. For example, in some circuit breaker designs it may be as simple as a specific valued resistor, while in other circuit breaker designs it may include other electrical components including capacitors, diodes and transistors. In one embodiment, the range plug 30 is wired directly into the circuitry of the circuit breaker as it is manufactured, such that the receptacle will have a specific predetermined amperage value. In another embodiment of the invention, the range plug 30 may be a removable and replaceable component so that an electrical parts distributor would need to carry only one, or a small number of different receptacles (perhaps different ones for different voltages), and the specific amperage value for each receptacle can be determined by the parts distributor or an electrician. In such an embodiment, the location of the range plug may be internal of the receptacle housing or in a relatively inaccessible location, such as the rear of the housing. In another embodiment, the range plug 30 may be removable and replaceable, and may be located directly on the face of the receptacle. In such an arrangement, the parts distributor, an electrician, or even the user will be able to select or modify the amperage value for the circuit breaker by selecting the appropriate range plug and inserting it into the opening in the face of the receptacle. If circumstances change, the amperage value of the receptacle (and its subcircuit) can easily be changed by removing the old range plug 30 and replacing it with a differently valued range plug.

Other ampere values for the range plug 30 can be selected so that the circuit breaker comprised by the current detector 50 and switch 54 will trip, or cause the switch 54 to open, at different ampere values. For example, a 15 amp or 20 amp range plug can be utilized. In any event, the range plug 30 would need to be selected to have a value not greater than the value of the circuit protection device 44 located in the main circuit. Downstream of the switch 54 an electrical line 58 is tapped off of line 56 and a second electrical line 60 is tapped off of a line 62 leading from line 48. Lines 58 and 60 lead to the two outlets 22, 24 which are accessible from the face of the receptacle 10 as seen in FIG. 1. Thus, these outlets are protected by the current detector 50 and will provide a source of electrical current so long as the switch 54 is closed.

The LED 28 is optionally provided across lines 56 and 62, downstream of the switch 54, in order to provide a visual indication at the face of the receptacle that power is available at the receptacle. An additional electrical receptacle 64 is shown which is connected by electrical lines 66, 68 to openings 36, 38 and the second pair of terminals in the circuit breaker receptacle 10. This further receptacle 64, which can be a standard 20 amp electrical receptacle, includes outlets 70 and 72 which are also protected by the current detector 50 and switch 54 at the amperage level of the range plug 30. Further additional receptacles such as 64 can be connected downstream of receptacle 64 as needed for the particular installation. Each of the further downstream receptacles will also be protected by the circuit breaker receptacle 10 and the aggregate amperage of the loads presented at all of the outlets on this sub-circuit will be limited by the value of the range plug 30.

It is a feature of an embodiment of the present invention that the value of the range plug 30 will be selected sufficiently well below the value of the circuit protection device 44 such that a plurality of sub-circuits such as that shown can be connected to lines 40, 42 so that a plurality of individually protected sub-circuits will be provided, each with a local reset button 26. For example, if the circuit protection device 44 is rated at 30 amps and the range plugs 30 in each of the sub-circuits are rated at 5 amps, at least six sub-circuits could be connected to lines 40, 42 thus providing six locally resettable independent sub-circuits.

The present invention can be used in new construction and new circuits, and it can also be used in existing construction and circuits. In some instances it may be necessary to run new wires, particularly if several existing, separate 20 amp circuits are to be replaced by fewer 30 amp circuits with multiple sub-circuits. Oftentimes this may be accomplished by pulling old wires out of existing conduits and pulling new wires through the old conduits.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A circuit breaker receptacle comprising:

a housing having a front face;

a circuit breaker located within said housing;

a range plug rated for a particular ampere value connected to said circuit breaker to set an ampere value to be used by said circuit breaker;

a pair of electrical terminals within said housing for receiving electrical lines connected to a source of electrical current;

an openable load break switch located within said housing and operable by said circuit breaker to move from a closed position to an open position upon said circuit breaker detecting a current in excess of said rated value of said range plug;

a reset trip free button carried in said housing and accessible at said front face of said housing, said button arranged to move from a first position to a second position upon the opening of said load break switch and said button being arranged to enable the closure of said switch upon a manually effected movement of said button back to said first position except that said button is not capable of holding said load break switch closed when said current remains in excess of said rated value of said range plug; and a second pair of electrical terminals within said housing for receiving electrical lines leading to additional circuit components.

2. A circuit breaker receptacle according to claim 1, further including at least one electrical outlet provided in said housing connected downstream of said switch and being exposed at said front face for receiving an electrical plug from an electrical device.

3. A circuit breaker receptacle according to claim 1, wherein said range plug is removably connected to said current detector at said front face of said housing.

4. A circuit breaker receptacle according to claim 1, wherein said circuit breaker comprises a current detector and a current range processor, with said range plug being connected to said current range processor.

5. A circuit breaker receptacle according to claim 1, further including an illuminating indicator connected to said second pair of electrical terminals for visually indicating that electrical power is available at said second pair of terminals and that said switch is in a closed position.

6. A circuit breaker receptacle according to claim 5, wherein said illuminated indicator comprises an LED.

7. A circuit breaker receptacle according to claim 1, wherein said reset button is extendable from said front face of said housing upon the opening of said switch and said button arranged to enable the closure of said switch upon a depression of said button into said face of said housing.

8. A circuit breaker receptacle according to claim 1, wherein a plurality of differently rated range plugs are provided so that a selected one of said plugs is connected to said current detector to provide an opening of said switch at a selected amperage value.

9. A circuit breaker receptacle comprising:

a housing having a front face;

a current detector located within said housing;

a range plug rated for a particular ampere value connected to said current detector to set an ampere value to be detected by said current detector;

a pair of electrical terminals within said housing for receiving electrical lines connected to a source of electrical current;

an openable switch located within said housing and operable by said current detector to move from a closed position to an open position upon said detector detecting a current in excess of said rated value of said range plug;

a reset button carried in said housing and accessible at said front face of said housing, said button arranged to move from a first position to a second position upon the opening of said switch and said button being arranged to enable the closure of said switch upon a manually effected movement of said button back to said first position;

a pair of electrical outlets provided in said housing connected downstream of said switch and being exposed at said front face for receiving electrical plugs from electrical devices; and a second pair of electrical terminals within said housing for receiving electrical lines leading to additional circuit components.

10. A circuit breaker receptacle according to claim 9, further including an indicator connected to said second pair of electrical terminals for visually indicating that electrical current is available at said second pair of terminals and that said switch is in a closed position.

11. A circuit breaker receptacle according to claim 9, wherein said reset button is extendable from said front face of said housing upon the opening of said switch and said button arranged to enable the closure of said switch upon a depression of said button into said face of said housing.

12. A circuit breaker receptacle according to claim 9, wherein a plurality of differently rated range plugs are provided so that a selected one of said plugs is connected to said current detector to provide an opening of said switch at a selected amperage value.

13. A circuit breaker receptacle according to claim 9, wherein said range plug is removably connected to said circuit detector at said front face of said housing.

14. An electrical circuit having a plurality of electrical outlets connected thereto comprising:

a main circuit having a hot lead and a neutral lead;

at least one sub-circuit having a first line leading from said hot lead and a second line leading from said neutral lead;

a resettable circuit breaker connected in said sub-circuit on said first line;

a range plug rated for a particular ampere value connected to said circuit breaker to set an ampere value to cause said circuit breaker to trip;

at least one of said outlets plurality of electrical connected to said sub-circuit downstream from said circuit breaker; and ate least one of said plurality of electrical outlets connected to said electrical circuit, but not in series with said sub-circuit outlet.

15. An electrical circuit according to claim 14, further including a housing for said circuit breaker which has a first pair of terminals for connecting to said first and second lines and a second pair of terminals to which further electrical lines can be connected to provide electrical power downstream of said sub-circuit outlet.

16. An electrical circuit according to claim 15, further including an illuminated indicator connected to said second pair of electrical terminals for visually indicating that electrical current is available at said second pair of terminals.

17. An electrical circuit according to claim 14, wherein said circuit breaker includes a reset button which is extendable from an exposed portion of said circuit breaker upon the tripping of said circuit breaker and said button is arranged to enable the resetting of said circuit breaker upon a manual depression of said button.

18. An electrical circuit according to claim 14, wherein a plurality of differently rated range plugs are provided so that a selected one of said plugs is connected to said circuit breaker to provide a tripping of said circuit breaker at a selected amperage value.

19. An electrical circuit according to claim 14, wherein said range plug is connected to said circuit breaker in an easily removable and replaceable manner.

20. An electrical circuit according to claim 19, wherein a plurality of differently rated range plugs are provided so that a selected one of said plugs is connected to said circuit breaker to provide a tripping of said circuit breaker at a selected amperage value.

* * * * *